US006719138B2

(12) United States Patent
Austin et al.

(10) Patent No.: US 6,719,138 B2
(45) Date of Patent: Apr. 13, 2004

(54) DEVICE AND METHOD FOR COVERING A BABY'S BOTTLE

(76) Inventors: Kathleen Austin, 220 Delaware Ave., Milford, NJ (US) 08848; Jeffrey R Austin, Jr., 220 Delaware Ave., Milford, NJ (US) 08848

( * ) Notice: Subject to any disclaimer, the term of this patent is extended or adjusted under 35 U.S.C. 154(b) by 0 days.

(21) Appl. No.: 09/921,966

(22) Filed: Aug. 6, 2001

(65) Prior Publication Data

US 2003/0024840 A1 Feb. 6, 2003

(51) Int. Cl.[7] ..... B65D 85/00; B65D 77/00; A63H 33/00

(52) U.S. Cl. ..... 206/459.1; 206/217; 446/227

(58) Field of Search ..... 206/459.1, 573, 206/457, 223, 217; 215/11.1, 11.6; 248/102; 150/154; 446/227, 297, 304

(56) References Cited

U.S. PATENT DOCUMENTS 2,522,381 A * 9/1950 Kramer ..... 215/11.6
2,929,290 A * 3/1960 Smith ..... 215/11.6
4,898,060 A * 2/1990 To ..... 215/11.1
5,313,807 A * 5/1994 Owen ..... 62/457.3
5,344,034 A * 9/1994 Eagan ..... 215/11.1
5,523,741 A * 6/1996 Cane ..... 340/573.1
5,664,745 A * 9/1997 Hadaway ..... 215/11.1
6,192,137 B1 * 2/2001 Heo ..... 2/912

FOREIGN PATENT DOCUMENTS

CH 690165 A5 * 5/2000 ..... A63H/5/00

* cited by examiner

*Primary Examiner*—Mickey Yu
*Assistant Examiner*—Gregory Pickett
(74) *Attorney, Agent, or Firm*—Eric A. LaMorte

(57) ABSTRACT

A cover device for covering a baby bottle. The device includes a cloth bottle cover that has a closed bottom end and an open top end. A pocket is disposed on the cloth bottle cover. An audible signal generator is provided that is placed in the pocket of the cloth bottle cover. The audible signal generator creates an audible signal when press-activated. The bottle cover with the audible signal generator is advanced over a baby bottle. The bottle cover provides a medium by which a child can better grasp the bottle. Furthermore, the bottle cover insulates the bottle and absorbs drips from the bottle. The audible signal generator is activated when a child presses against the cover above the audible signal generator. As such, the use of the present invention adds visual and audible interest to a baby bottle as well as making the bottle easier to hold and use.

8 Claims, 2 Drawing Sheets

DEVICE AND METHOD FOR COVERING A BABY'S BOTTLE

BACKGROUND OF THE INVENTION

1. Field of the Invention

The present invention relates to covers that are placed around beverage containers. More particularly, the present invention relates to covers that are designed to receive baby bottles.

2. Prior Art Statement

Traditional baby bottles are made of glass or plastic and are smooth to the touch. As such, these bottles are not intended to be held by infants or toddlers. Rather, these bottles are intended to be held by an adult who is feeding the child the bottle.

However, as a child grows, he/she develops enough muscle control to hold their own bottle as they feed. Commonly, parents use the same bottles that were used when the child was younger. As such, the bottles tend to be smooth and have a wide diameter that is hard for a child to hold. A young child therefore finds it difficult to grasp such bottles and often drops such bottles due to that child's inability to adequately grasp the exterior of the bottle.

The prior art is replete with different types of handles that attach to different types of bottles. Such handles are designed to help a child grasp and hold their own bottle. Such handles, however, tend to make the bottle heavier and bulkier, thereby causing difficulties, especially for children that are just old enough to hold their own bottles. Furthermore, many handles must be grasped in a specific orientation. If a child grasps a bottle at a point where the handle is not present, the handles may actually hinder a child's ability to drink from that bottle.

The prior art is also replete with specialized bottles that are designed with integral handles to help a child hold onto that bottle. Such bottles, however, require that parents buy new specialized bottles as the child gets older.

Soon after a child develops to a point where they can hold their own bottle, that child often begins to play with the bottle as if it were a toy. The child will then play with the bottle and periodically drink from the bottle while playing. It is for this reason that many baby bottles are decorated. The decorations make the bottles visibly interesting to small children and therefore more interesting for play.

The present invention is a lightweight, cloth cover for a baby bottle. The cover makes a standard baby bottle much easier to hold by an infant without adding greatly to the bulk or weight of the bottle. Furthermore, the cover adds visual interest to the bottle for play value. Lastly, the bottle cover contains a music source that generates music when touched. These features thereby make the bottle more interesting to play with and more soothing from which to drink.

SUMMARY OF THE INVENTION

The present invention is a cover device for covering a baby bottle. The device includes a cloth bottle cover that has a closed bottom end and an open top end. A pocket is disposed on the cloth bottle cover. An audible signal generator is provided that is placed in the pocket of the cloth bottle cover. The audible signal generator creates an audible signal when press-activated. The bottle cover with audible signal generator is advanced over a baby bottle. The bottle cover provides a medium by which a child can better grasp the bottle. Furthermore, the bottle cover insulates the bottle and absorbs drips from the bottle. The audible signal generator is activated when a child presses against the cover in the area above the audible signal generator. As such, the use of the present invention adds visual and audible interest to a baby bottle as well as making the bottle easier to hold and use.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
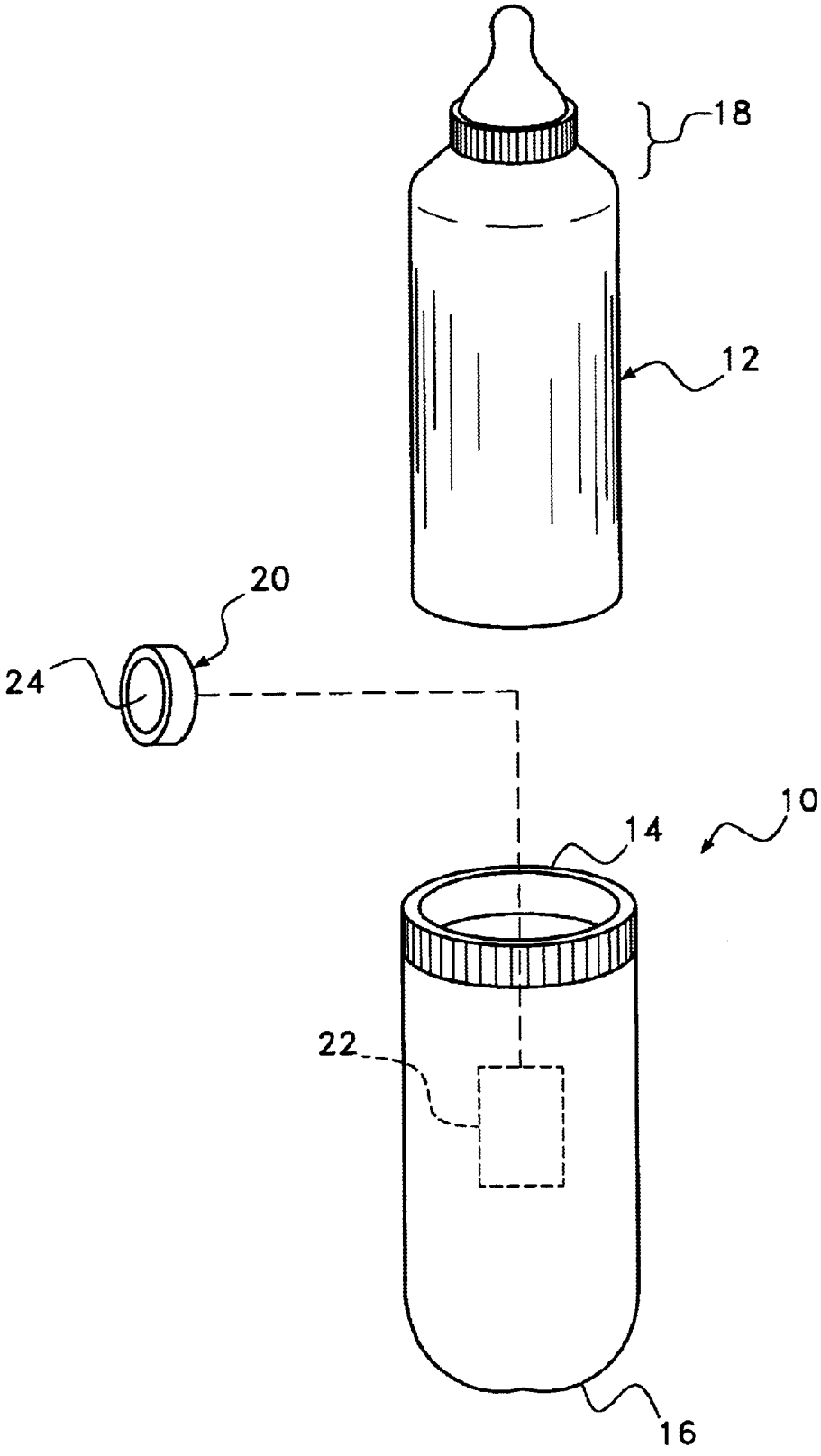
FIG. 1 is an exploded perspective view of an assembly containing a bottle cover device and a traditional baby bottle.

Referring to FIG. 1, an exemplary embodiment of the present invention bottle cover device 10 is shown in conjunction with a traditional baby bottle 12. The bottle cover 10 is made of cloth fabric, and is sewn in a configuration having an open top end 14 and a closed bottom end 16. The bottle cover device 10 is sized to receive the baby bottle 12. Elastic is present in the bottle cover device 10 near its open top end 14. Accordingly, as the baby bottle 12 is placed into the bottle cover device 10, the open top end 14 of the bottle holder device 10 is biased against the baby bottle 12. The open top end 14 of the bottle cover device 10 passes into the neck region 18 of the baby bottle 12, thereby actively holding the bottle cover device 10 onto the baby bottle 12.

The bottle cover device 10 has a diameter that is approximately one to three inches wider than is the exterior of the baby bottle 12. The result is a bottle cover device 10 that is slack when placed around a baby bottle 12. This provides material and folds for a small child to grasp, when holding the bottle cover device 10 and bottle 12. The bottle cover device 10 therefore enables a child to grasp and hold a bottle at any point on the exterior of the bottle.

In addition to providing a graspable surface, the bottle cover device 10 provides an absorbent shield around the baby bottle 12. As the baby drinks from the bottle 12, any leakage, condensation, drool or run-off that flows down the face of the bottle 12 is absorbed by the material of the bottle cover device 10. The result is that a baby drinking from a bottle 12 and using the bottle cover device 10 becomes less messy and requires less after-feeding cleaning than does a baby with a traditional uncovered bottle. The baby bottle cover device 10 also acts as an insulator for the bottle 12. Many times a baby's formula is warmed to body temperature before fed to a baby. The presence of the bottle cover device 10 around the baby bottle 12 helps maintain the temperature of the formula in the bottle. Then, as a child is weaned off of formula and is introduced to refrigerated liquids, the presence of the baby bottle cover device 10 helps maintain the colder temperature of these fluids. As such, a bottle filled with dairy milk will last longer without spoiling with the use of the baby bottle cover device 10.

The bottle cover device 10 is preferably made of colorful material that is highly decorated. The bottle cover device 10 can be produced in a wide variety of popular baby motifs and can be monogrammed with the names or initials of the baby.

In addition to being visually interesting, the bottle cover device 10 also contains an audible signal generator 20. The audible signal generator 20 creates an audible signal when activated. The audible signal can be synthesized words, animal sounds and the like. However, in the preferred embodiment, the audible signal generator 20 creates music in a predetermined melody.

The audible signal generator 20 is an assembly that is carried in an internal pocket 22 of the bottle cover device 10. The audible signal generator 20 is a self-contained assembly containing a housing, electronics, a speaker and an activation button. The activation button 24 is located on the face of the audible signal generator 20. When the activation button 24 is pressed, the audible signal generator 20 generates a melody for a predetermined period of time. Many audible signal generators are commercially available. Any such audible signal generator can be adapted for use with the present invention bottle cover device 10.

Figure 2:
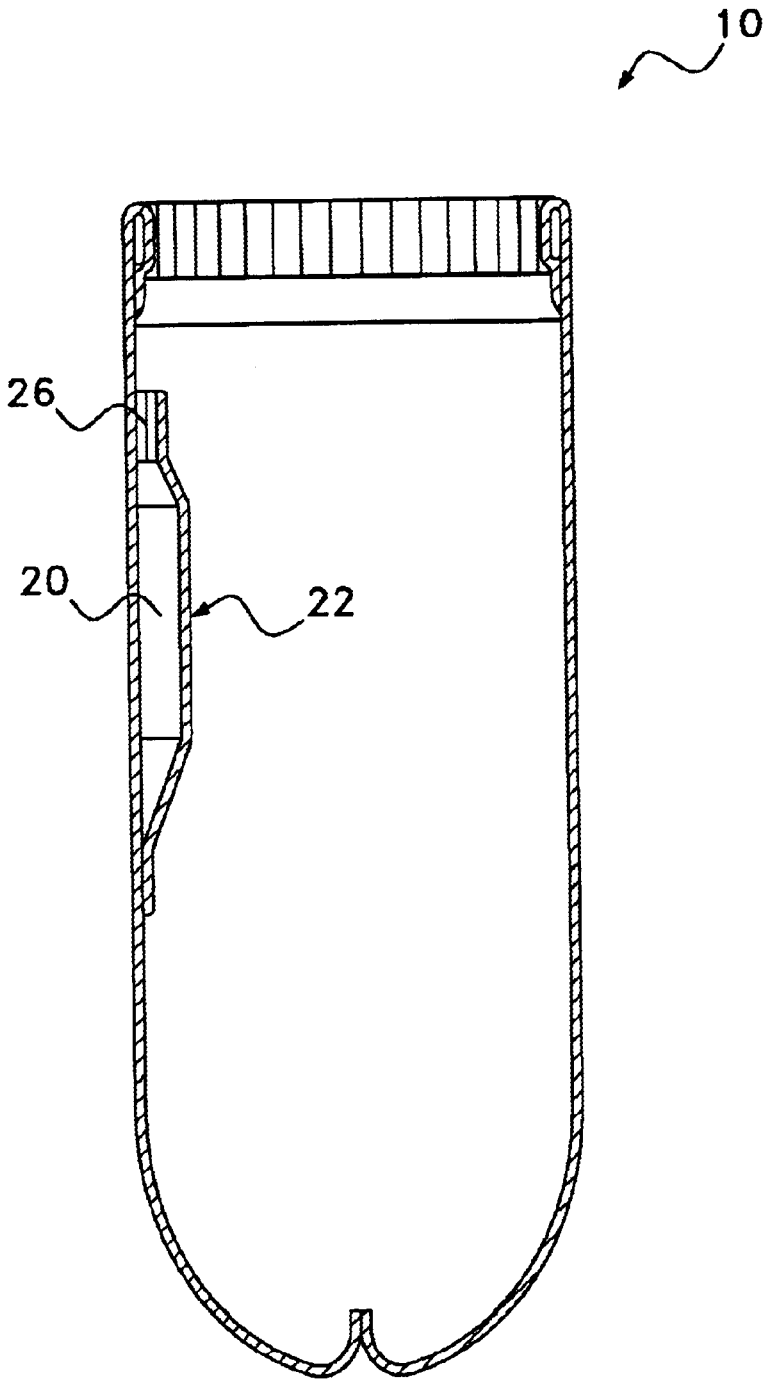
FIG. 2 is a selectively cross-sectioned view of the bottle cover device shown in FIG. 1, viewed along section line 2—2.

Referring now to FIG. 2, it can be seen that within the bottle cover device 10 is a pocket 22. The pocket 22 is sized to receive the audible signal generator 20. The top of the pocket 22 is open. However, hook and loop material 26 is present along the top of the pocket 22 so that the pocket 22 can be selectively locked closed. The presence of the hook and loop material 26 prevents the audible signal generator 20 from falling out of the pocket 20 and becoming a choking hazard. However, the presence of the hook and loop material 26 enables the pocket 20 to be selectively opened and the audible signal generator 20 removed. In this manner, the bottle cover device 10 can be periodically laundered in a washing machine without damage to the audible signal device 20. The use of hook and loop material 26 is optional for closing the pocket 22. It should be understood that any type of fastener, such as a zipper, buttons, and the like can be used.

In an alternative embodiment, the audible signal generator 20 can be sealed in a waterproof pouch and permanently sewn into the pocket. However, to enable batteries to be changed and for different audible signal generators to be used at different times, an openable pocket is preferred.

Returning to FIG. 1, it will be understood that to use the bottle cover device 10, an audible signal generator 20 is selected and is placed into the pocket 22 on the interior of the bottle cover device 10. The pocket is then closed and a baby bottle 12 is inserted into the bottle cover device 10. As the baby bottle 12 is inserted into the bottle cover device 10, the elastic at the open top end 14 of the bottle cover device 10 expands. When the elastic at the open top end 14 of the bottle cover device 10 reaches the neck region 18 of the baby bottle 12, the elastic contracts around the neck region 18, thereby holding the bottle cover device 10 in place on the baby bottle 12.

As a child is given the baby bottle 12 with the bottle cover device 10 in place, the child is able to grasp the bottle cover device 10 at any point. Accordingly, no matter where the child places his/her hands, that child can grasp the bottle cover device 10 at that point. As the child manipulates the bottle 12 and touches the bottle 12 at different points, a child's hand may pass over the audible signal generator 20 that is held on the interior of the bottle cover device 10. If the audible signal generator 20 is pressed, the audible signal generator 20 is activated and a melody is played. Accordingly, a child will hear music as the child drinks from the bottle or plays with the bottle. After the child has finished feeding, the audible signal generator 20 can be removed and the bottle cover device 10 laundered.

It will be understood that the embodiment of the present invention device described and illustrated is merely exemplary and a person skilled in the art can make many variations to the shown embodiment. For example, there are many different types and styles of baby bottles. The shape of the bottle cover device can be made to fit any prior art bottle. Furthermore, there are many ways to make the open end of the bottle cover device close around a bottle. The use of an elastic band is merely exemplary. Other elements, such as strings, hook and loop straps and the like can be adapted for use in tightening the open top end of the bottle cover. All such alternate embodiments and modifications are intended to be included within the scope of the present invention as defined below in the claims.

What is claimed is:

1. An assembly comprising:

a baby bottle having a base end, a nipple end and a predetermined length between said base end and said nipple end, wherein said bottle does not exceed a first diameter between said base end and said nipple end;

a cloth cover having a closed bottom end and an open top end, said cloth cover defining an interior area with a diameter larger than said first diameter, wherein said bottle cover loosely receives the base end of the baby bottle therein and extends a majority of bottle predetermined length along said baby bottle toward said nipple end while forming slack folds around said baby bottle;

a pocket formed in said cloth cover in a pocket area between said closed bottom end and said open top end;

an audible signal generator disposed within said pocket, wherein said audible signal generator is activated by being manually pressed.

2. The assembly according to claim 1, wherein said cloth cover has an interior surface and an exterior surface and said pocket is disposed on said interior surface of said cloth cover.

3. The assembly according to claim to 1, further including a closure mechanism on said pocket for selectively closing said pocket and locking said audible signal generator in said pocket.

4. The assembly according to claim 1, wherein said cloth cover contains a contracting element proximate said open top end.

5. The assembly according to claim 4, wherein said contracting element is an elastic band.

6. The assembly according to claim 1, wherein said audible signal generator generates a melody for a predetermined period of time when activated.

7. A method of covering a baby bottle, comprising the steps of:

providing a cloth cover that can receive at least a portion of said baby bottle therein, wherein said cloth cover is wider than said baby bottle;

providing a pocket within said cloth clover;

placing an audible signal generator within said pocket of said cover; and advancing said cloth cover around the baby bottle, therein positioning said audible signal generator along a side of a said baby bottle, wherein said cloth cover forms slack folds around said portion of said baby bottle being covered providing surfaces for a baby to grasp said cloth cover.

8. The method according to claim 7, wherein said step of placing an audible signal generator includes locking said audible signal generator into said pocket.

* * * * *